US006658887B2

(12) United States Patent
Lee et al.

(10) Patent No.: US 6,658,887 B2
(45) Date of Patent: Dec. 9, 2003

(54) DISPENSER AND REFRIGERATOR FITTED WITH THE SAME

(75) Inventors: Gab Young Lee, Kyongsangnam-do (KR); Song Leem Choi, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/408,244

(22) Filed: Apr. 8, 2003

(65) Prior Publication Data

US 2003/0196447 A1 Oct. 23, 2003

(30) Foreign Application Priority Data

Apr. 17, 2002 (KR) ..... P2002-21030
May 6, 2002 (KR) ..... P2002-24813

(51) Int. Cl.[7] ..... B67D 5/62
(52) U.S. Cl. ..... 62/389; 62/391; 141/351
(58) Field of Search ..... 62/389, 391; 222/146.6; 141/9, 351, 392

(56) References Cited

U.S. PATENT DOCUMENTS 3,934,758 A * 1/1976 Kipp ..... 222/108
4,809,879 A * 3/1989 Hanley ..... 221/125
4,930,554 A * 6/1990 Alley ..... 141/97
5,346,297 A * 9/1994 Colson et al. ..... 312/215
5,768,905 A * 6/1998 Oh ..... 62/264
5,788,117 A * 8/1998 Zimmanck ..... 221/285
6,135,173 A * 10/2000 Lee et al. ..... 141/361

* cited by examiner

*Primary Examiner*—William C. Doerrler
*Assistant Examiner*—Mohammad M. Ali
(74) *Attorney, Agent, or Firm*—Fleshner & Kim, LLP

(57) ABSTRACT

Dispenser for dispensing water or ice cubes, and refrigerator fitted with the same, the dispenser including a dispenser casing having a cup receiving space recessed from an outside surface of one side of a refrigerator, and view securing means provided in an upper front part for identifying a water level of a cup when a user looks down the cup receiving space from an upper front side, at least one lever fitted to the cup receiving space, and a dispensing device built-in the refrigerator for cold, or frozen storage of water supplied from outside of the refrigerator, and supplying the water or ice cubes to the cup when the cup presses the lever. The dispenser is fitted to an outside of the refrigerator, particularly, to an outside of the door.

24 Claims, 3 Drawing Sheets

DISPENSER AND REFRIGERATOR FITTED WITH THE SAME

This application claims the benefit of the Korean Application Nos. P2002-21030 filed on Apr. 17, 2002, and P2002-24813 filed on May 6, 2002, which are hereby incorporated by reference.

BACKGROUND OF THE INVENTION

1. Field of the Invention

The present invention relates to a dispenser for dispensing water or ice cubes to a cup inserted thereto, and a refrigerator fitted with the same in an outside surface thereof.

2. Background of the Related Art

The refrigerator is an appliance for fresh, and long time storage of food. The refrigerator is provided with a food storage therein, which is always kept at a low temperature by means of a refrigerating cycle for maintaining a fresh state of the food. For cooling down the food storage, the refrigerator is provided with a compressor for compressing and circulating refrigerant, a condenser for condensing compressed refrigerant into liquid phase refrigerant, a heat exchanger for vaporizing the condensed refrigerant to absorb heat from an inside of the food storage, a fan for blowing cold air around the heat exchanger to the inside of the food storage, and refrigerant tubes for connecting the compressor, the condenser and the heat exchanger.

In the meantime, the refrigerator is also provided with a door for opening closing the food storage at one side thereof, for an example, in a front surface thereof. Accordingly, it is necessary for a user to open the door for storage of food or taking out stored food. When the door is opened, the cold air flows from the food storage to an exterior, and warm air flows from the exterior to the food storage, leading to raise a temperature of the food storage. Once the temperature of the food storage is raised, the compressor comes into operation to circulate the refrigerant and cool down the food storage to a low temperature again. If opening of the door is frequent, operation periods of various components thereof starting from the compressor and the fan, become longer, and much power is consumed. Moreover, a temperature variation of the food storage becomes greater to drop freshness of the food stored therein.

Referring to FIG. 1, recently for solving this problem, even a little, refrigerators with dispensers 3 is provided for dispensing water or ice cubes from an outside of the refrigerator without opening the door 2. The dispenser 3 is provided to one side of the refrigerator, such as an outside surface of door 2, which will be described, briefly.

There is a cup receiving space 3*c* recessed from an outside surface of the door 2 having a water dispensing lever 3*a* and an ice dispensing lever 3*b*. Inside of the door 2, there are a water tank and an ice maker (not shown) for dispensing water or ice cubes when the cup is pushed in, to move the water dispensing lever 3*a* or the ice dispensing lever 3*b*.

When the refrigerator fitted with the dispenser 3 is provided, since the user can be take water or ice cubes without opening the door 2, the refrigerator is not only convenient, but also reduce power consumption.

However, the present refrigerator fitted with a dispenser has a disadvantage in that a level of water or ice cubes dispensed to the cup put into the cup receiving space can not be known. That is, in general, since user's eyes are positioned higher than the dispenser 3 with reference to a floor, if the user puts the cup into the cup receiving space, a user view is shaded by an upper front part of the dispenser 3, to fail watching an inside of the cup.

Therefore, in order to prevent water or ice cubes from overflowing, there is an inconvenience in that the user is required to bend his neck or back forward for watching the level of water or ice cubes dispensed to the cup.

Moreover, the failure in watching the level of the water or ice cubes dispensed to the cup frequently causes overflow of the ice cubes or the water.

SUMMARY OF THE INVENTION

Accordingly, the present invention is directed to a dispenser and a refrigerator fitted with the same that substantially obviates one or more of the problems due to limitations and disadvantages of the related art.

An object of the present invention is to provide a dispenser and a refrigerator fitted with the same, in which an upper front part of the dispenser is improved for easy watching of a level of the water or ice cubes dispensed to a cup.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the dispenser includes a dispenser casing having a cup receiving space recessed from an outside surface of one side of a refrigerator, and view securing means provided in an upper front part for identifying a water level of a cup when a user looks down the cup receiving space from an upper front side, at least one lever fitted to the cup receiving space, and a dispensing device built-in the refrigerator for cold, or frozen storage of water supplied from outside of the refrigerator, and supplying the water or ice cubes to the cup when the cup presses the lever.

The dispenser casing is provided, for an example, to an outside of a door. The dispenser casing is formed as a body separate from, for an example, the door, or as another example, as one unit with the outside surface of the door.

The view securing means includes an upper front part of the dispenser casing, of, for an example, a transparent material for easy see-through to the cup receiving space from an outside of the dispenser. The upper front part includes a form extended a distance down from, for an example, the outside surface of the refrigerator, and bent backward therefrom.

The view securing means includes a top cover forming an upper part of the dispenser casing extended, for an example, a distance down from the outside surface of the refrigerator and bent backward therefrom, and formed of a transparent material for enabling see-through to the cup receiving space from an outside of the dispenser.

In another embodiment of the present invention, the view securing means includes, for an example, a sloped chamfered surface provided to the upper front part of the dispenser casing. The chamfered surface is a straight sloped surface from upper front side to a lower rear side of the dispenser casing. The chamfered surface is a highly glossy reflective surface for identifying the level of water inside of the cup by means of reflection of a light.

In another embodiment of the present invention, the view securing means further includes, for an example, a mirror attached to the chamfered surface.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, the same parts will be given the same names and reference symbols, and repetitive description of which will be omitted.

Figure 1:
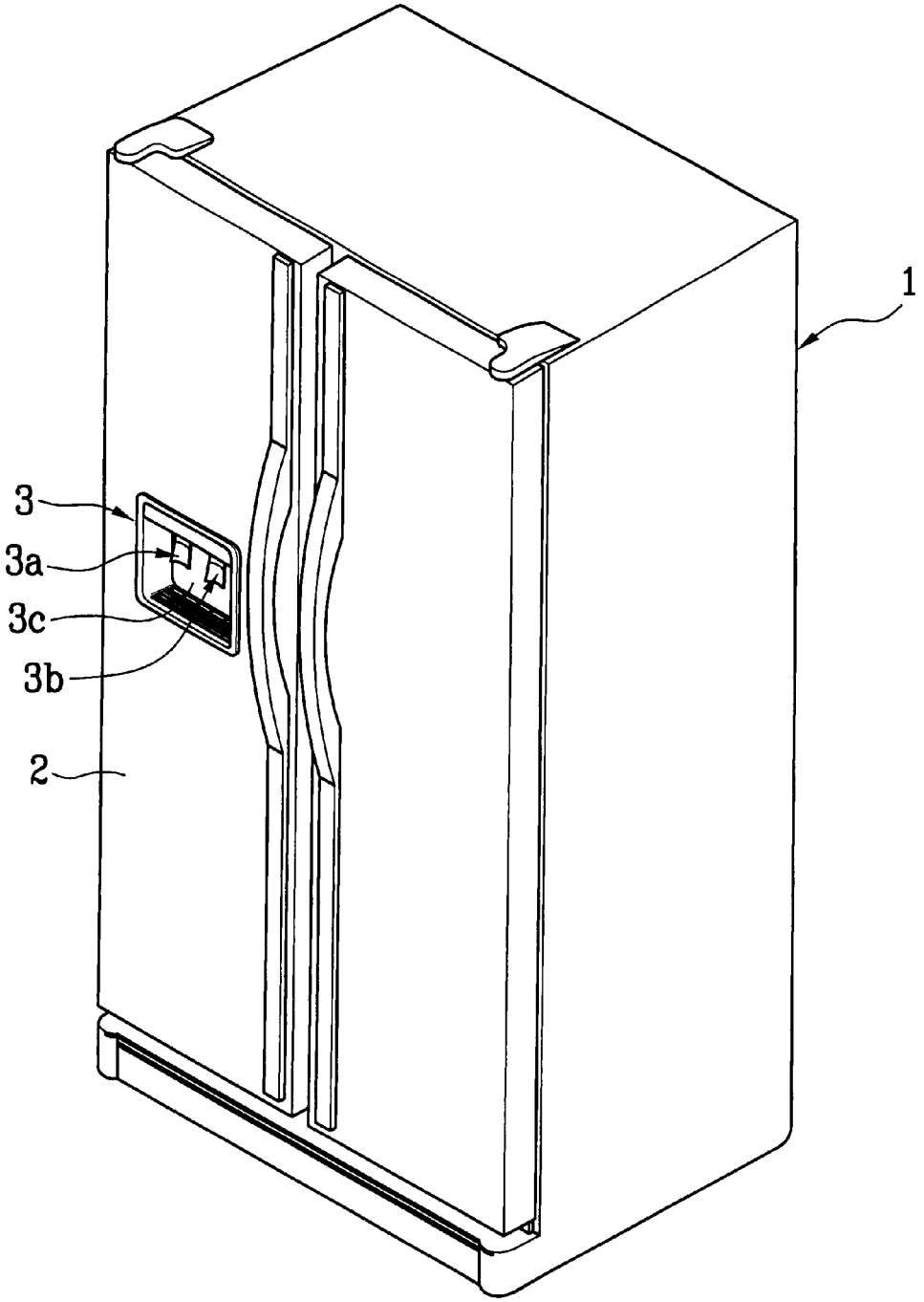
FIG.1 Prior Art
FIG. 1 illustrates a perspective view of a refrigerator fitted with a dispenser.
Figure 2:
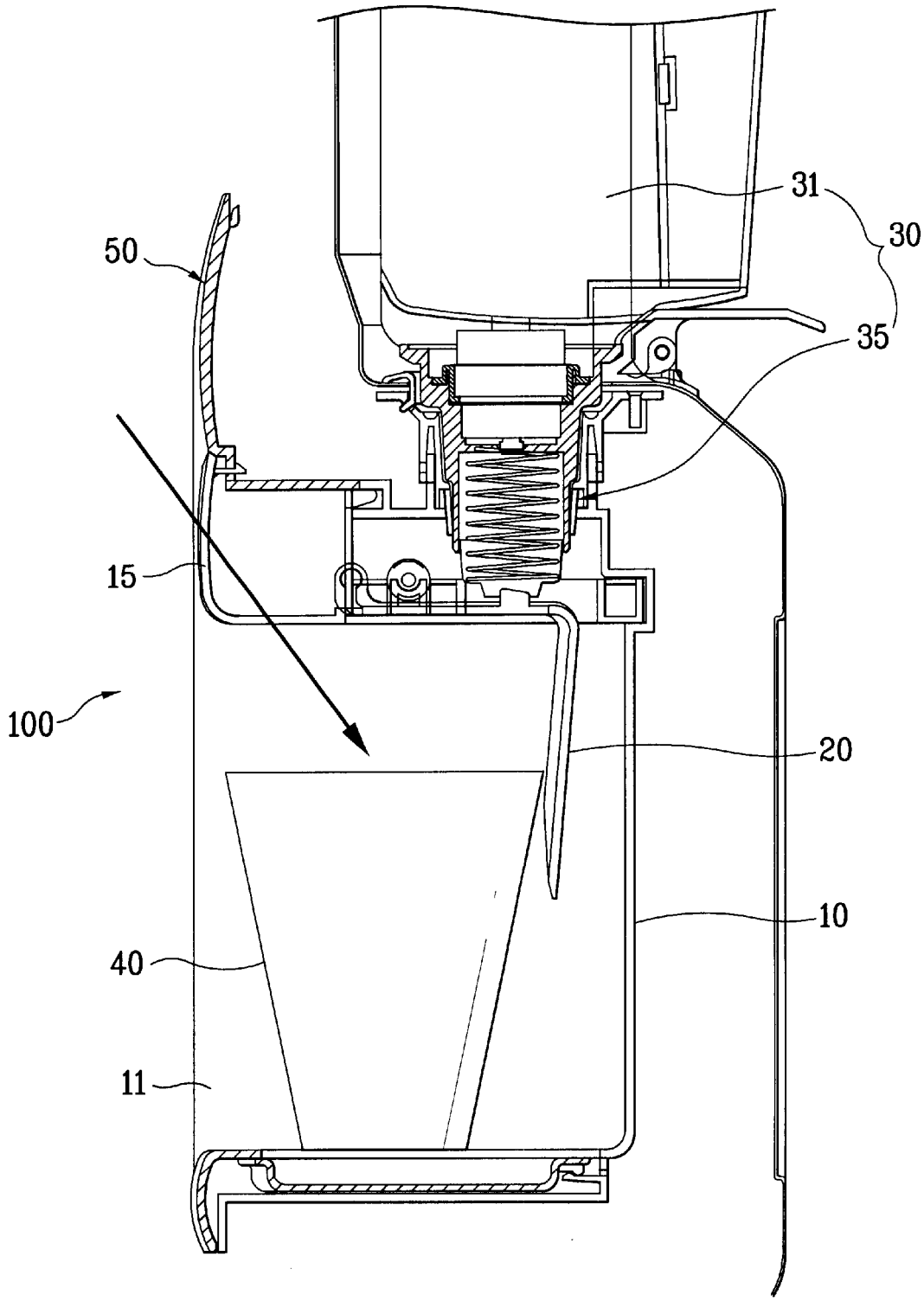
FIG. 2 illustrates a section of a dispenser in accordance with a preferred embodiment of the present invention.
Figure 3:
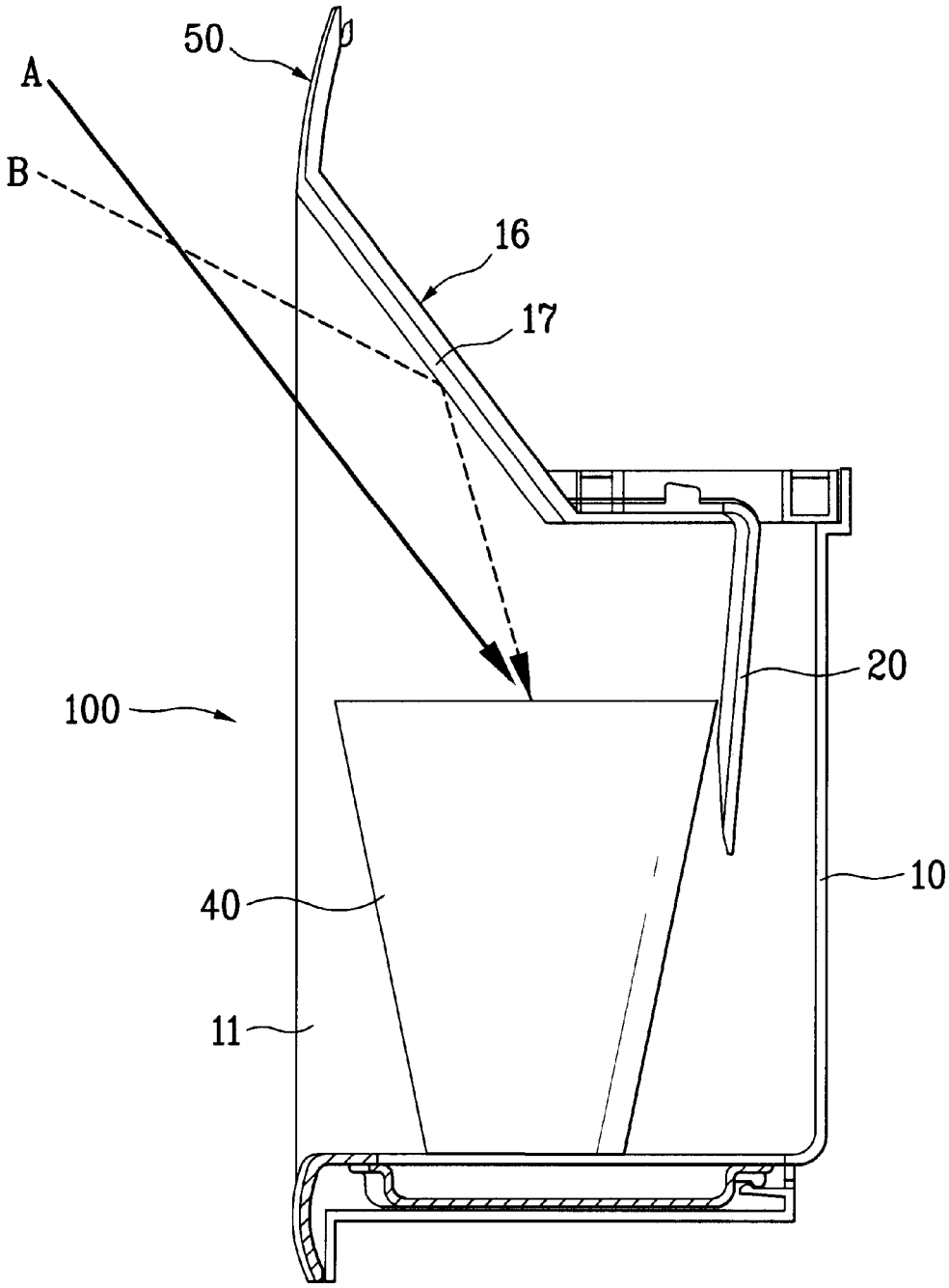
FIG. 3 illustrates a section of a dispenser in accordance with another preferred embodiment of the present invention.

Referring to FIGS. 2 and 3, the dispenser includes a dispenser casing 10 having view securing means, at least one lever 20, and a device 30 for dispensing water or ice cubes.

The dispenser casing 10 is recessed from an outside surface of one side of the refrigerator, for an example, the door 50, to form a cup receiving space 11 therein. The dispenser casing 10 is fabricated as a body separate from the door 50 and fitted to the door 50. However, the dispenser casing 10 is not limited to one fabricated separate from the door 50 and fitted to the door 50, but the dispenser casing 10 can be fabricated as one unit with the door 50. That is, if a part of the outside surface of the door 50 is recessed to form the cup receiving space, the separate fabrication and fitting of the dispenser casing 10 to the door 50 is not required.

The dispensing device 30 is built in the casing or the door 50 of the refrigerator. The dispensing device 30 includes a water tank 31 for receiving water from exterior and store the water therein, and a water supply nozzle 35 under the water tank 31 for supplying the water stored in the water tank 31 to the cup receiving space 11. A water supply tube (not shown) connected to an external water resource supplies water to the water tank 31. In the meantime, since the water stored in the water tank 31 through the water supply tube is cooled down as the water heat exchanges with the cold air in the food storage of the refrigerator, there is cold water in the water tank 31 always.

In the meantime, besides the water tank 31 and the water supply nozzle 35, the dispensing device may further include an ice maker (not shown) and an ice outlet (not shown). In this instance, besides the water tank 31, the water supply tube is connected to, and supplies water to the ice maker. The ice maker supplied with water through the water supply tube makes ice cubes and stores therein as the ice maker heat exchanges with the cold air in a freezing chamber. The ice outlet supplies the ice cubes from the ice maker to the cup receiving space 11.

Referring to FIGS. 2 and 3, the lever 20 is provided to the cup receiving space 11. The lever 20 is fitted such that, when the cup 40 is put into the cup receiving space 11, the lever 20, is pushed back by the cup 40, and opens the water supply nozzle 35. According to this structure, since the water supply nozzle 35 is opened as the lever 20 is pushed back by the cup 40, cold water stored in the water tank 31 can be supplied to the cup 40.

In the meantime, in a case the ice maker and the ice outlet is provided to the dispenser 100 of the present invention, a separate lever (not shown) is provided to the cup receiving space 11 for opening/closing the ice outlet. Once such a system is provided, alike the foregoing principle, if the cup 40 is inserted into the cup receiving space 11, the ice cubes can be supplied to the cup 40.

In the meantime, the view securing means is provided to the upper front part of the dispenser casing 10, and serves to secure a view of the user such that, when the user looks down the cup receiving space 11 from a front upper side, the user can identify the water level of the cup 40 inside of cup receiving space 11. In the present invention, there may be a variety of embodiments of the view securing means, of which typical ones will be described with reference to FIGS. 2 and 3.

FIG. 2 illustrates a section of a dispenser in accordance with a preferred embodiment of the present invention, wherein a system of one embodiment of the view securing means is best shown.

Referring to FIG. 2, the view securing means includes an upper front part of the dispenser casing 10 of a transparent material for easy see through of the cup 40 when the user looks down the cup 40 in the cup receiving space 11 in an oblique direction from an upper front side of the dispenser 100.

The upper front part of the dispenser casing 10 may be formed as one unit with the other parts of the dispenser casing 10. However, as shown in FIG. 2, the upper front part of the dispenser casing 10 is not limited to this, but may be fabricated separately, to form a top cover 15. As the top cover 15 is attached to a part of the door 50 together with other parts of the dispenser casing 10, the top cover 15 actually forms an upper part and a front outer appearance of the upper part of the dispenser casing 10. The upper front part or the top cover 15 of the dispenser casing 10 provided thus may be formed of glass or transparent plastic.

In the meantime, the upper front part of the dispenser casing 10 has a form extended down a length from an outside surface of the refrigerator, more precisely, from an outside surface of the door 50 and bent backward therefrom. Of course, as shown in FIG. 2, if the upper front part of the dispenser casing 10 is the top cover 15, the top cover 15 has a form extended down a length from the outside surface of the refrigerator, more precisely, from the outside surface of the door 50 and bent backward therefrom.

If the upper front part or the top cover 15 of the dispenser casing 10 is formed of a transparent material, a user's view can be secured when water or ice cubes is supplied from the dispenser 100 to the cup 40. That is, when water or ice cubes is supplied from the dispenser 100 to the cup 40, a view of the user has a slope from the upper front of the dispenser 100 to the cup 40 put in the cup receiving space 11 indicated with an arrow in FIG. 2. Though the sloped view is shaded by the upper front part of the dispenser casing 10, in the present invention, since the upper front part or the top cover 15 of the dispenser 100, that shades the user view, is formed of a transparent material, the user can identify the level of water inside of the cup 40 by looking through it.

In the meantime, FIG. 3 illustrates a section of a dispenser in accordance with another preferred embodiment of the present invention, wherein a system of another embodiment of the view securing means is best shown.

Referring to FIG. 3, the view securing means includes a sloped chamfered surface 16 provided in the upper front part of the dispenser casing 10. As shown in FIG. 3, the chamfered surface 16 is sloped from an upper front to a lower rear of the dispenser casing 10. Though the chamfered surface 16 has a straight slope, the chamfered surface may have a curved slope or a slope with many bends.

As shown with the arrow 'A' in FIG. 3, once the chamfered surface 16 is provided to the upper front of the dispenser casing 10, removing the upper front corner of the dispenser casing 10 that shades the user's view, it is very convenient for a relatively tall user to use the dispenser 100.

In the meantime, the another embodiment of the present invention further provides a structure for identifying the level of water inside of the cup 40 from an outside of the dispenser casing 10 by using reflection of a light.

For this, the chamfered surface 16 is formed of a highly glossy reflective surface that can reflect a light. The reflective surface may be formed of a highly glossy metal surface, which may be formed by attaching a metal mirror or a metal film, or coating a metal. As another example, as shown in FIG. 3, a mirror 17 may be attached to the chamfered surface 16. Once the mirror 17 is attached to the chamfered surface 16, the water level can be identified more accurately.

If the chamfered surface 16 is formed of the reflective surface or has the mirror attached thereto, which permits to identify the water level of the cup 40 indirectly by using the reflected light as indicated with an arrow 'B' in FIG. 3, it is very convenient to users with relatively short heights.

Meanwhile, the refrigerator of the present invention includes a refrigerator casing having food storage inclusive of a refrigerating chamber and a freezing chamber, a door hinged to one side of an opened front of the refrigerator casing for opening/closing the food storage, and a dispenser fitted to the refrigerator casing or an outside surface of the door.

In the foregoing refrigerator of the present invention, since other parts excluding the dispenser are similar to a known refrigerator, description of the refrigerator will be omitted, and, since the dispenser is described with reference to FIGS. 2 and 3 in detail, description of which will also be omitted.

The foregoing dispenser 100 of the present invention fitted to a refrigerator is used as follows.

When the user puts the cup 40 into the cup receiving space 11 and pushes the lever 20 with the cup 40, the lever 20 is pushed back to open the water supply nozzle 35. Once the water supply nozzle 35 is opened, the cold water stored in the water tank 31 is supplied to the cup 40 through the water supply nozzle 35.

When the water is supplied to the cup 40 from the water supply nozzle 35, the user can identify the water level of the cup 40 through the view securing means.

If the view securing means is the top cover 15 or the upper front part of the dispenser casing 10, the user can identify the water level of the cup 40 by looking through it.

If the view securing means is the chamfered surface 16, the user can identify the water level of the cup 40 with the sloped view. If the chamfered surface 16 has the reflective surface or the mirror 17 attached thereto, the water level can be identified by means of reflection of light.

After receiving water at the cup 40 while identifying the water level through the view securing means, the cup 40 is taken out of the cup receiving space 11 if the water is supplied to an appropriate level. Then, the lever 20 pushed back by the cup 40 is returned to an original position, to close the water supply nozzle 35, the supply of water through the water supply nozzle 35 is stopped.

In the meantime, if the dispenser 100 of the present invention is provided with the ice maker and the ice outlet, after pushing back the lever with the cup by the same method with above, the user can receive the ice cubes supplied to the cup from the ice outlet while identifying the water level by means of the view securing means.

Thus, the dispenser and the refrigerator fitted with the same of the present invention have the following advantages.

First, the user can identify a water level through the view securing means easily while the user receives water or ice cubes at the cup.

Second, the easy identification of the level of the water or ice cubes supplied to the cup permits reception of an appropriate amount of water or ice at the cup, to prevent overflow out of the cup in advance.

It will be apparent to those skilled in the art that various modifications and variations can be made in the LCD and method for fabricating an LCD of the present invention without departing from the spirit or scope of the invention. Thus, it is intended that the present invention cover the modifications and variations of this invention provided they come within the scope of the appended claims and their equivalents.

What is claimed is:

1. A dispenser comprising:

a dispenser casing having a cup receiving space recessed from an outside surface of one side of a refrigerator, and view securing means provided in an upper front part for identifying a water level of a cup when a user looks down the cup receiving space from an upper front side;

at least one lever fitted to the cup receiving space; and a dispensing device built-in the refrigerator for cold, or frozen storage of water supplied from outside of the refrigerator, and supplying the water or ice cubes to the cup when the cup presses the lever.

2. The dispenser as claimed in claim 1, wherein the view securing means includes an upper front part of the dispenser casing, of a transparent material for easy see-through to the cup receiving space from an outside of the dispenser.

3. The dispenser as claimed in claim 2, wherein the upper front part includes a form extended a distance down from the outside surface of the refrigerator, and bent backward therefrom.

4. The dispenser as claimed in claim 1, wherein the view securing means includes a top cover forming an upper part of the dispenser casing extended a distance down from the outside surface of the refrigerator and bent backward therefrom, and formed of a transparent material for enabling see-through to the cup receiving space from an outside of the dispenser.

5. The dispenser as claimed in claim 1, wherein the view securing means includes a sloped chamfered surface provided to the upper front part of the dispenser casing.

6. The dispenser as claimed in claim 5, wherein the chamfered surface is a straight sloped surface from upper front side to a lower rear side of the dispenser casing.

7. The dispenser as claimed in claim 5, wherein the chamfered surface is a highly glossy reflective surface for identifying the level of water inside of the cup by means of reflection of a light.

8. The dispenser as claimed in claim 5, wherein the view securing means further includes a mirror attached to the chamfered surface.

9. The dispenser as claimed in claim 1, wherein the dispenser casing is fitted to an outside surface of a door of the refrigerator.

10. The dispenser as claimed in claim 9, wherein the dispenser casing is fabricated as a body separate from the door.

11. The dispenser as claimed in claim 10, wherein the view securing means includes an upper front part of the dispenser casing of a transparent material for easy see-through to the cup receiving space from an outside of the dispenser.

12. The dispenser as claimed in claim 11, wherein the view securing means includes a top cover forming an upper part of the dispenser casing extended a distance down from the outside surface of the refrigerator and bent backward therefrom, and formed of a transparent material for enabling see-through to the cup receiving space from an outside of the dispenser.

13. The dispenser as claimed in claim 10, wherein the view securing means includes a sloped chamfered surface provided to the upper front part of the dispenser casing.

14. The dispenser as claimed in claim 13, wherein the chamfered surface is a straight sloped surface from upper front side to a lower rear side of the dispenser casing.

15. The dispenser as claimed in claim 9, wherein the dispenser casing is formed as a unit with the outside surface of the door.

16. The dispenser as claimed in claim 15, wherein the view securing means includes a sloped chamfered surface provided to the upper front part of the dispenser casing.

17. The dispenser as claimed in claim 16, wherein the view securing means further includes a mirror attached to the chamfered surface.

18. A dispenser comprising:

a casing having a food storage therein kept at a low temperature;

a door for opening/closing one opened side of the casing;

a dispenser casing having a cup receiving space recessed from an outside surface of one side of the casing or the door, and view securing means provided in an upper front part for identifying a water level of a cup when a user looks down the cup receiving space from an upper front side;

at least one lever fitted to the cup receiving space; and a dispensing device built-in the refrigerator for cold, or frozen storage of water supplied from outside of the refrigerator, and supplying the water or ice cubes to the cup when the cup presses the lever.

19. The dispenser as claimed in claim 18, wherein the casing is provided to the door.

20. The dispenser as claimed in claim 19, wherein the view securing means includes a top cover forming an upper part of the dispenser casing extended a distance down from the outside surface of the refrigerator and bent backward therefrom, and formed of a transparent material for enabling see-through to the cup receiving space from an outside of the dispenser.

21. The dispenser as claimed in claim 19, wherein the view securing means includes an upper front part of the dispenser casing extended a distance down from the outside surface of the refrigerator and bent backward therefrom, and formed of a transparent material for enabling easy see-through to the cup receiving space from an outside of the dispenser.

22. The dispenser as claimed in claim 19, wherein the view securing means includes a chamfered surface in an upper front part of the dispenser casing sloped from an upper front side to a lower rear side of the dispenser casing.

23. The dispenser as claimed in claim 22, wherein the chamfered surface is a highly glossy reflective surface for identifying the level of water inside of the cup by means of reflection of a light.

24. The dispenser as claimed in claim 22, wherein the view securing means further includes a mirror attached to the chamfered surface.

* * * * *